US006329927B1

(12) United States Patent
Hobson

(10) Patent No.: US 6,329,927 B1
(45) Date of Patent: Dec. 11, 2001

(54) ALERT LIGHT

(76) Inventor: Richard S. Hobson, 6824 Canby Ave. Suite 101, Reseda, CA (US) 91335

( * ) Notice: Subject to any disclaimer, the term of this patent is extended or adjusted under 35 U.S.C. 154(b) by 0 days.

(21) Appl. No.: 09/317,533

(22) Filed: May 24, 1999

(51) Int. Cl.[7] ..... G08B 7/00

(52) U.S. Cl. ..... 340/815.69; 340/815.73; 340/321; 340/331; 340/404.1; 340/691.1; 340/692; 362/171; 116/137 R

(58) Field of Search ..... 340/815.69, 815.55, 340/815.7, 815.73, 815.74, 815.76, 321, 326, 331, 691.1, 692, 573.1, 566, 404.1; 362/157, 158, 171, 196, 202, 800, 23, 30, 102, 103, 104, 109; 116/202, 137 R

(56) References Cited

U.S. PATENT DOCUMENTS 5,079,679 * 1/1992 Chin-Fa ..... 362/800
5,311,100 * 5/1994 Brain ..... 340/604
5,952,916 * 9/1999 Yamabe ..... 340/321

* cited by examiner

*Primary Examiner*—Donnie L. Crosland

(57) ABSTRACT

An alert device that includes a tubular encasement holding battery powered marking light, a compass and a whistle, the tubular encasement and whistle are threadedly interconnected and rotating the whistle of the device with respect to the tubular encasement serves to provide electrical communication activating the light, with the light serving to light up the face of the compass.

14 Claims, 2 Drawing Sheets

ALERT LIGHT

FIELD OF THE INVENTION

The present invention relates to a signal device and more particularly to a signal device for identifying the location of a person lost in the desert, woods, lakes, rivers or seas.

BACKGROUND OF THE INVENTION

Common epitaphs over the centuries have been statements such as "child lost in forest","lost at sea", "searching lake bottom" and the like. Literally thousands of persons have been lost in the woods and subject to hypothermia or dislocated from a boat or ship often at night and often in strong winds and rough sea waves. Often such persons are under water at depths of 20, 40 or 100 or more feet. Countless hours have been spent searching for these dislocated persons, in some instances the persons are found unconscious and rescued through the use of CPR and/or the application of oxygen to bring the person back to consciousness. All too commonly the dislocated person dies due to the amount of time that is taken in locating the person.

Attempts have been made in the past to provide signaling or marking devices. During war time, servicemen have been provided with flares and/or small rockets that are fired off into the air if they are lost at sea. In other instances, a surface water coloring chemical is released on the surface of the water. Both of these assist in locating the person "lost at sea." Both have short comings. In order to fire off the small rockets the lost person must be conscious to activate the system; the same is true with respect to the water marking dye.

A need has been present over the years for a very simple marking device that may be worn by persons not at high risk such as fishermen, canoeists, and the like. The device must be small to avoid it being bothersome. The device is desirably automatic since the person is often unconscious and may be in a depth of water.

The present invention over comes the problems associated with prior devices. The present invention is small, lightweight, even decorative. The present device may be worn whenever the user goes into the forest or onto the water such as in a fishing boat or canoe without being burdensome or objectionable.

SUMMARY OF THE PRESENT INVENTION

The present invention provides a marking device for identifying the location of a person that may be lost. The present invention is suitable for use in essentially all geographical locations. The present marking device is highly desirable for use in water locations where, due to darkness or submersion, it may be difficult for searchers to find the individual. The present invention may include a light emitting means powered by a means for powering together with a means for sound making. The present invention may further include a compass to assist the wearer in identifying the direction in which the wearer is traveling.

The marking device is a tubular water proof encasement. The tubular water proof encasement has a first chamber that is water proof and contains the various electrical components, such as one or more light emitting means, corresponding circuits and one or more means for powering. The light emitting means may be deposed within the first chamber. The tubular water proof encasement and first chamber desirably are constructed by injection molding of a transparent polymer. The tubular water proof encasement and the first chamber may be constructed with at least a portion being transparent.

The means for sound making may be constructed by injection molding of a polymer. The means for sound making may be a simple whistle construction such as the type used by traffic direction police officers.

The first chamber may have threading means on a second end and the whistle may have cooperating threading means so that the whistle may be threadedly engaged with the first chamber. The first chamber and the whistle will generally be tubular in construction having walls sufficiently thick to avoid accidental breakage during normal use. The walls may be transparent or translucent so as to allow light from the light emitting means to be seen. The circuitry contained in the first chamber may include a pair of electrical contacts that extend through the wall of the first chamber into a second chamber.

The whistle may include a switch means for interconnecting the pair of electrical contacts to complete the electrical continuity to provide power between the means for powering and the circuitry leading to the light emitting means. The switch means may be moved into a position of interconnecting the pair of electrical contacts by simple rotation of the whistle with respect to the first chamber using the threaded engagement.

In one preferred embodiment, the marking device includes a zone (or second chamber) between the whistle and the adjacent portion of the first chamber containing the exposed electrical contact such that water may fill the second chamber thereby providing electrical contact automatically when submerged. In other words, the water provides the electrical continuity between the contacts.

The present invention may be worn by any of a wide variety of persons that are walking in the woods or forest, boating on lakes or canoeing on rivers. The present marking device is normally maintained in a standby condition with the light emitting means in an unpowered condition. The user may, from time to time, observe the compass to determine direction. If the wearer becomes disoriented or lost, the wearer may activate the light emitting means by rotating the whistle of the marking device with respect to the first chamber. The user may sound an alert by three sharp blasts on the whistle, repeated at timed intervals. Those within hearing distance will recognize the signal and seek out the wearer.

The present device may be similarly used if the wearer is lost while traveling on the water, such as in a speed boat on a large lake or traveling down a river by canoe. In the instances where the wearer is suddenly dislodged from the boat or canoe, the light emitting means is automatically moved to a powered condition by water flooding the second chamber adjacent to the pair of the electrical contacts. The water serves as the electrical connector between the contacts.

IN THE DRAWINGS

DETAILED DESCRIPTION OF THE INVENTION

Figure 1:
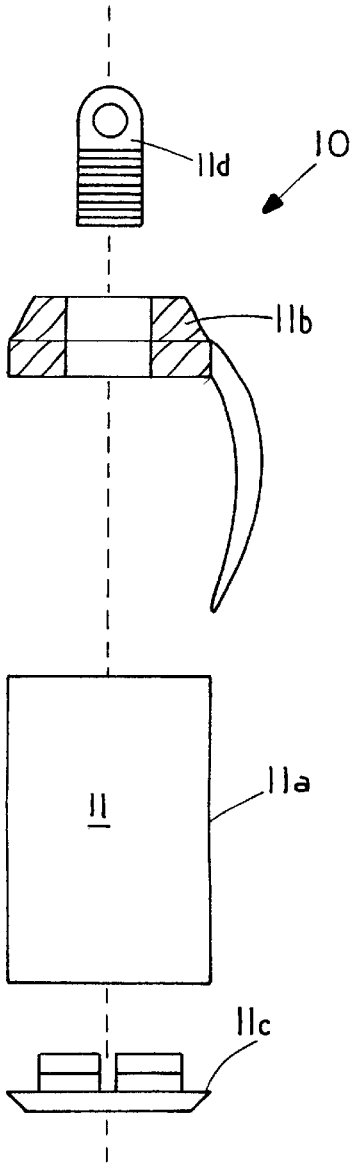
FIG. 1 shows an exploded view of the present invention.

The same reference numerals are used for the same parts in all seven figures; therefore, some parts will only be described in reference to the first embodiment though the discussion holds true for all embodiments.

The present invention (FIGS. 1–7) is a marking device 10 which is a tubular water proof encasement and has a first chamber 11. The first chamber 11 may have a first enclosing means and a second enclosing means for the first end and the second end, respectively. The first and second enclosing means may be a first end cap and a second end cap, respectively. The first end cap may be an upper end cap 11*b* and the second end cap may be a lower end cap 11*c*. The marking device 10 may contain the first end cap at the upper end and the second end cap at the lower end. The first chamber 11 (FIG. 1) may generally be defined by a circular wall portion 11*a*, the upper end cap 11*b*, and the lower end cap 11*c*. The upper end cap 11*b* may also include a removable eyelet 11*d* that may be threaded into the upper end cap 11*b*.

Figure 2:
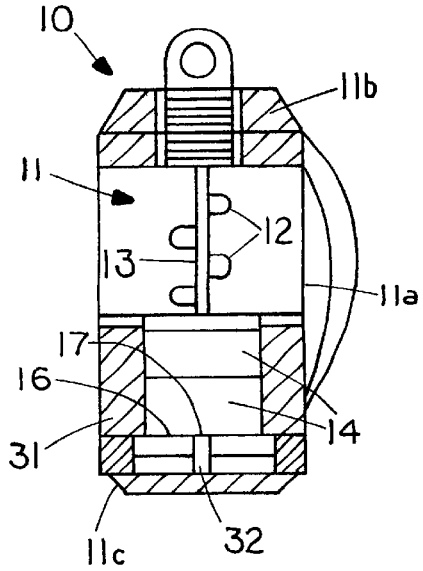
FIG. 2 shows the first embodiment of the present invention in an assembled condition.
Figure 4:
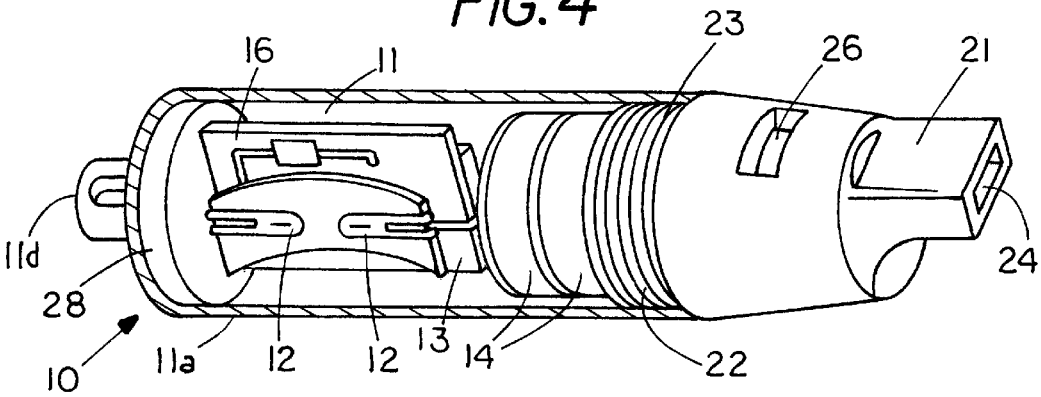
FIG. 4 shows the second embodiment of the present invention in an assembled condition.
Figure 5:
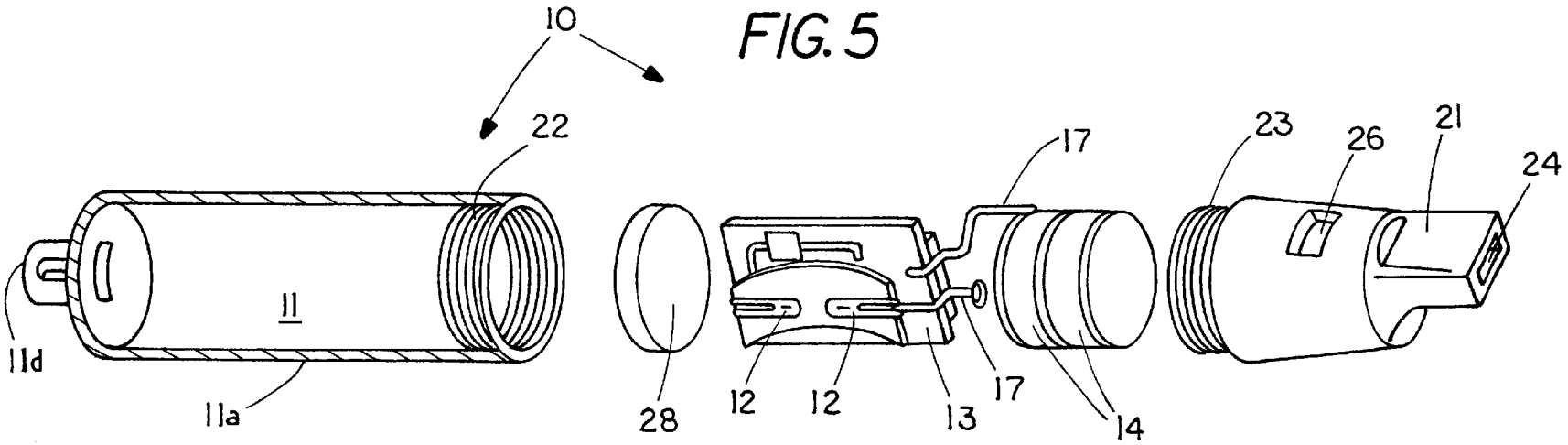
FIG. 5 shows an exploded side view of the second embodiment of the present invention.

The first chamber 11 may contain one or more light emitting means, such as light emitting diodes (LEDs) 12, and a circuit board 13 (FIGS. 2, 4, and 5). The light emitting diodes 12 may be conventional in nature and preferably about one twentieth of a watt. The circuit board 13 may be conventional in nature and serves to interconnect the light emitting diodes 12 with one or more means for powering. The circuit board 13 may also control the power to the LED's causing the LED's to blink or flash.

The means for powering may be one or more batteries 14. The batteries 14 may be of any suitable configuration such as disc or button shaped. The circuit board 13 has a first electrical path that provides electrical continuity between a first pole of the battery, such as the negative pole, and one side of the diodes. The second side of the light emitting diode is connected to a first electrical contact 16 that extends through the wall of the chamber 11. A second pole of the battery, such as the positive pole, is connected to an electrical conduit such as a small wire and a second contact 17 that likewise extends through the wall of the chamber 11 at a location adjacent to, but normally electrically separated from, the first contact 16.

The first chamber 11 may be completely water proof. A second chamber 31 (see FIG. 2) may be permeable to water. A third enclosing means may releasably enclose the second chamber 31 which may be disposed at one end of the tubular water proof encasement. The first chamber 11 may have a pair of light emitting diodes 12 which communicate with a first pole of the means for powering, such as one or more batteries 14, disposed within the first chamber 11. The second chamber 31 may have a first electrical contact 16 that communicates with the pair of light emitting diodes 12 and a second electrical contact 17 that communicates with a second pole of the means for powering. The second chamber 31 may be open to the reception of water when the marking device 10 is contacted with water. The water may provide electrical continuity between the second electrical contact 17 and the second pole of the battery, or batteries, and thus activating the pair of light emitting diodes 12 when water enters the second chamber 31.

Figure 3:
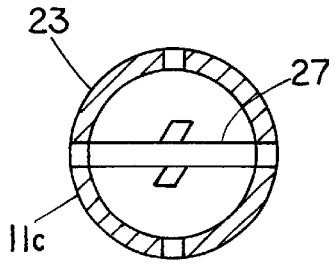
FIG. 3 shows a sectional view of the lower end cap of the present invention.

Electrical continuity may be completed between the first electrical contact 16 and the second electrical contact 17 with one of two switch means. One switch means is a metal bar 27 (FIG. 3). The bottom cap 11*c* may carry a metal bar 27 that serves to electrically interconnect the first electrical contact 16 and the second electrical contact 17 when in a powering condition. The metal bar 27 does not contact both contacts when in a second position of non-powering condition. In other words, the bar engages both the contacts 16 and 17 when in the powering condition and does not contact both contacts 16 and 17 when not in the powering condition. The bar 27 may be selectively moved from the powering condition to the non-powering condition. The bar 27 may be positioned in the lower end cap 11*c* such that rotating the lower end cap 11*c* will cause the bar 27 to move into and out of the powered condition.

The second way that electrical continuity can be achieved between the contacts 16 and 17 is by a second switch means. The second switch means is activated when water enters into the lower end cap 11*c* through an opening 32 (FIG. 2). The opening 32 allows water to enter the second chamber 31 and cause electrical continuity between the contacts 16 and 17.

SECOND EMBODIMENT

A second embodiment of the marking device 10 is shown in FIGS. 4–7. This embodiment includes a means for sound making such as a whistle 21 or an electrically powered buzzer. The second embodiment is essentially the same as the first embodiment, so only the major differences will be detailed here.

The second embodiment has a first and second enclosing means as does the first embodiment. A first enclosing means for a first end of a tubular water proof encasement is a compass 28. The second enclosing means for a second end of the tubular water proof encasement is a whistle 21. Primarily, the whistle 21 replaces the lower end cap 11*c* and a compass 28 replaces the upper end cap 11*b*. The circular wall portion 11*a* may have a threading means 22 suitable for engagement with a cooperating threading means 23 contained on the whistle 21. The whistle 21 may have the conventional components of a whistle including a central chamber 24 and a channel 26.

The whistle 21 also functions similar to the end cap 11*c* and the second chamber 31. The whistle 21 may function as the switch means. The whistle 21 may carry a metal bar 27 (shown in FIG. 3), that serves to electrically interconnect the two contacts 16 and 17 when in a powering condition, similar to the end cap 11*c*. The bar 27 may be positioned in the whistle 21 such that rotating the whistle 21 will cause the bar 27 to move into and out of the powered condition. In addition, electrical continuity can be achieved between the contacts 16 and 17 by water entering into the whistle 21 through the central chamber 24 and channel 26. The central chamber 24 and channel 26 allow water to enter and cause electrical continuity between the contacts 16 and 17.

Figure 7:
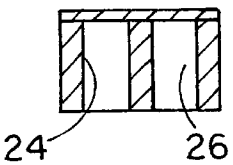
FIG. 7 shows a sectional view of the whistle portion of the present invention.
Figure 6:
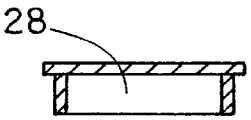
FIG. 6 shows a sectional view of the compass of the present invention.

FIG. 6 shows a cross-section of the compass of the second embodiment. FIG. 7 shows a cross-section of the whistle of the second embodiment. The central chamber 24 and the channel 26 are shown in FIG. 7.

USE OF THE PRESENT INVENTION

The marking device 10 of the present invention may be carried on a lanyard around the neck of the user while taking hikes or traveling on water such as in a boat. The marking device 10 is normally in the non-operating condition, e.g. turned off. If the user wishes to determine the direction of travel, the user holds the marking device 10 in an upright position with the compass pointed upright. The user may blow on the whistle if the user is attempting to gain the attention of others, e.g. if the user is lost or needs rescue. If the user is traveling at night, the marking device 10 may be placed in the operating condition to send out a signal that can be observed by others. The others can then locate the user and rescue the user.

What is claimed is:

1. A marking device for lost persons in need of rescue, said marking device including: a first chamber, at least a portion of said first chamber being transparent; a first enclosing means for releasably enclosing a first end of said first chamber, said first enclosing means including a compass, said compass having a face; a second enclosing means for releasably enclosing a second end of said first chamber; said second enclosing means comprising structure providing a whistle; light emitting means disposed within said first chamber, whereby light emitted by said light emitting means is transmitted through said transparent portion; means for powering said light emitting means disposed within said first chamber; and switch means for interconnecting said light emitting means and said means for powering thereby activating said light emitting means.

2. The marking device of claim 1, wherein said light emitting means comprises at least one light emitting diode.

3. The marking device of claim 1, wherein said means for powering said light emitting means comprises at least one battery.

4. The marking device of claim 1, wherein said light emitting means comprises at least a pair of light emitting diodes.

5. The marking device of claim 4, wherein said light emitting means comprises four light emitting diodes.

6. The marking device of claim 5, wherein said second end of said first chamber includes a threading means; said second enclosing means includes a cooperating threading means; said switch means comprises said threading means of said first chamber and said cooperating threading means of said second enclosing means whereby the rotation of said second enclosing means with respect to said second end of first chamber results in the closure of electrical circuit contacts between said means for powering and the four light emitting diodes.

7. The marking device of claim 5, wherein said means for powering said light emitting means comprises at least one battery.

8. The marking device of claim 7, wherein said four light emitting diodes emit light that is transmitted through the face of said compass and thus serving to light the face of the compass when said light emitting diode is powered by said battery.

9. The marking device of claim 7, wherein said four light emitting diodes of said marking device are automatically activated when said marking device is submerged in water.

10. The marking device of claim 9, wherein said four light emitting diodes communicating with a first pole of said battery, a second chamber having a first electrical contact that communicates with said four light emitting diodes and a second electrical contact that communicates with a second pole of said battery, said second chamber being open to the reception of water when the marking device is contacted with water, said water serving to provide electrical continuity between said second electrical contact and said second pole of said battery and thus activating said light emitting diode when water enters the second chamber.

11. A marking device for lost persons in need of rescue, said marking device including: a tubular water proof encasement, at least a portion of said tubular water proof encasement being transparent; said tubular water proof encasement including a first chamber; a second enclosing means for releasably enclosing a second end of said first chamber, said second enclosing means comprising structure providing a whistle; light emitting means disposed within said first chamber, said light emitting means comprising at least one light emitting diode; a compass disposed within said first chamber, whereby light emitted by said light emitting means is transmitted through said transparent portion of said first chamber and lights said compass; means for powering said light emitting means; and switch means for interconnecting said light emitting means and said means for powering thereby activating said light emitting means, said switch means comprising means for interacting with water to provide electrical continuity between said means for powering and said light emitting means when the marking device has been submerged in water, said first chamber being normally sealed with respect to water, said light emitting means communicating with a first pole of said means for powering; a second chamber having a first electrical contact that communicates with said light emitting means and a second electrical contact that communicates with a second pole of said means for powering, said second chamber being open to the reception of water when the marking device is contacted with water, said water serving to provide electrical continuity between said second electrical contact and said second pole of said means for powering and thus activating said light emitting means when water enters the second chamber.

12. A marking device for persons, said marking device including: a tubular water proof encasement, said water proof encasement including walls defining a first chamber, at least a portion of said tubular water proof encasement being transparent to visible light; a third enclosing means for releasably enclosing a second chamber disposed at one end of said water proof encasement, said third enclosing means comprising structure providing a whistle; light emitting means disposed within said first chamber, said light emitting means comprising at least one light emitting diode; a compass disposed within said first chamber, whereby light emitted by said light emitting means is transmitted through said transparent portion of said water proof encasement, said light emitting means serving to light said compass to enable visual observation of the compass at night; means for powering said light emitting means; and a switch means for interconnecting said light emitting means and said means for powering thereby activating said light emitting means.

13. The marking device of claim 12, wherein the means for powering said light emitting means comprises at least one battery; said light emitting means comprises at least one light emitting diode.

14. The marking device of claim 13, wherein said switch means comprises means for interacting with water to provide electrical continuity between said means for powering and said light emitting means when the marking device has been submerged in water, wherein said first chamber containing said battery, said light emitting diode and said compass, said first chamber being normally sealed with respect to water, said light emitting diode communicating with a first pole of said battery, a second chamber having a first electrical contact that communicates with said light emitting diode and a second electrical contact that communicates with a second pole of said battery, said second chamber being open to the reception of water when the marking device is contacted with water, said water serving to provide electrical continuity between said second electrical contact and said second pole of said battery and thus activating said light emitting diode when water enters the second chamber.

* * * * *